US009770750B2

(12) United States Patent
Banik et al.

(10) Patent No.: US 9,770,750 B2
(45) Date of Patent: Sep. 26, 2017

(54) METHOD AND FORMING TOOL FOR HOT FORMING AND PRESS HARDENING WORKPIECES OF SHEET STEEL, IN PARTICULAR GALVANIZED WORKPIECES OF SHEET STEEL

(71) Applicant: ThyssenKrupp Steel Europe AG, Duisburg (DE)

(72) Inventors: Janko Banik, Altena (DE); Sascha Sikora, Lunen (DE); Maria Koeyer, Dortmund (DE); Thomas Struppek, Werne (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 215 days.

(21) Appl. No.: 14/360,079

(22) PCT Filed: Oct. 16, 2012

(86) PCT No.: PCT/EP2012/070445

§ 371 (c)(1),
(2) Date: May 22, 2014

(87) PCT Pub. No.: WO2013/075888

PCT Pub. Date: May 30, 2013

(65) Prior Publication Data

US 2014/0311205 A1 Oct. 23, 2014

(30) Foreign Application Priority Data

Nov. 23, 2011 (DE) ..... 10 2011 055 643

(51) Int. Cl.
*B21D 37/16* (2006.01)
*B21D 22/02* (2006.01)
(Continued)

(52) U.S. Cl.
CPC ..... *B21D 22/022* (2013.01); *B21D 22/208* (2013.01); *B21D 37/16* (2013.01); *C21D 1/673* (2013.01); *C21D 1/22* (2013.01)

(58) Field of Classification Search
CPC .... B21D 22/022; B21D 22/06; B21D 22/208; B21D 37/16; C21D 1/18; C21D 1/22;
(Continued)

(56) References Cited

U.S. PATENT DOCUMENTS 3,703,093 A * 11/1972 Komatsu ..... B21D 24/16 148/647
5,916,389 A 6/1999 Lundstrom
(Continued)

FOREIGN PATENT DOCUMENTS

DE 34665 1/1965
DE 19723655 A1 12/1997
(Continued)

*Primary Examiner* — Peter DungBa Vo
*Assistant Examiner* — Joshua D Anderson
(74) *Attorney, Agent, or Firm* — The Webb Law Firm

(57) ABSTRACT

A method and forming tool for hot forming and press hardening plate-shaped or preformed workpieces of sheet steel, wherein the workpiece is heated to a temperature above the austenitisation temperature and is then formed and quenched in a cooled forming tool having a punch and a female mold, wherein the female mold is coated in its drawing edge region with material in a material-uniting manner and/or is provided there with at least one insert part having a thermal conductivity at least 10 W/(m*K) lower than the thermal conductivity of the portion of the female mold adjacent to the drawing edge region and comes into contact with the workpiece when said workpiece is being hot formed and press hardened, the surface of the material having a transverse dimension within the range of 1.6 times to 10 times the positive radius of the female mold.

9 Claims, 2 Drawing Sheets

(51) Int. Cl.
*B21D 22/20* (2006.01)
*C21D 1/673* (2006.01)
*C21D 1/22* (2006.01)

(58) Field of Classification Search
CPC . C21D 1/62; C21D 1/673; C21D 1/68; C21D 1/70; C21D 2221/02
USPC ..... 72/342.1–342.96, 364
See application file for complete search history.

(56) References Cited

U.S. PATENT DOCUMENTS

| | | | | |
|---|---|---|---|---|
| 8,613,819 | B2 | 12/2013 | Vehof | |
| 2009/0178740 | A1 * | 7/2009 | Lenze | B21D 22/02 148/648 |
| 2012/0186705 | A1 | 7/2012 | Sikora et al. | |

FOREIGN PATENT DOCUMENTS

| | | | | |
|---|---|---|---|---|
| DE | 19943250 | A1 * | 4/2001 | B21D 22/20 |
| DE | 102004038626 | B3 | 2/2006 | |
| DE | 102009018798 | A1 | 10/2009 | |
| DE | 102009043926 | A1 | 3/2011 | |
| DE | 102009060388 | A1 | 6/2011 | |
| DE | 102010012579 | B3 | 7/2011 | |
| EP | 2248623 | A1 | 11/2010 | |
| GB | 2313848 | A | 12/1997 | |
| JP | 2007075834 | A | 3/2007 | |

* cited by examiner

METHOD AND FORMING TOOL FOR HOT FORMING AND PRESS HARDENING WORKPIECES OF SHEET STEEL, IN PARTICULAR GALVANIZED WORKPIECES OF SHEET STEEL

CROSS-REFERENCE TO RELATED APPLICATIONS

This application is the United States national phase of International Application No. PCT/EP2012/070445 filed Oct. 16, 2012, and claims priority to German Patent Application No. 10 2011 055 643.5 filed Nov. 23, 2011, the disclosures of which are hereby incorporated in their entirety by reference.

BACKGROUND OF THE INVENTION

Field of the Invention

The invention relates to a method for hot forming and press hardening plate-shaped or preformed workpieces of sheet steel, in particular galvanized workpieces of sheet steel, in which the workpiece is heated to a temperature above the austenitisation temperature and is then formed and quenched in a cooled forming tool having at least one punch and at least one female mold. The invention also relates to a forming tool for hot forming and press hardening plate-shaped or preformed workpieces of sheet steel, in particular galvanized workpieces of sheet steel, having at least one punch and a female mold associated with said punch, the punch and/or the female mold having cooling ducts for conducting a cooling fluid.

Description of Related Art

Devices are known for hot forming and press hardening workpieces of sheet steel, which devices have at least two tool halves, regions of these tool halves being configured such that they have different thermal conduction characteristics which are used to enable the adjustment of locally differing strength characteristics in the component to be produced. The method implemented by these devices is known by experts as "tailored tempering". A corresponding device is disclosed, for example, in DE 10 2009 018 798 A1.

It is also known to increase the dimensional accuracy and fitting accuracy of formed components in that the tool halves used for production have positive radii in the region of curves of the workpiece and they form air spaces in the opposite regions, projections being configured adjacently to the air spaces such that a non-warping clamping is facilitated. As a result, different hardness degrees can also be set in the component. A corresponding device for producing hardened components of sheet steel is described in DE 10 2004 038 626 B3.

Tests have shown that when galvanized steel blanks are hot formed in conventional forming tools, cracks sometimes appear in the zinc coating. The cracks can spread into the blank and thus the component may fail prematurely.

The object of the present invention is to provide a method and a forming tool of the type mentioned at the outset, which improve the flow characteristics of steel materials during the hot forming procedure, thereby significantly reducing the risk of cracks appearing during the hot forming of workpieces of sheet steel, in particular of galvanized steel blanks.

SUMMARY OF THE INVENTION

According to the invention, the female mold used for hot forming and press hardening is coated in its corner region, defined by a positive die radius, with material and/or is provided with at least one insert part having a thermal conductivity which is at least 10 W/(m*K) lower than the thermal conductivity of the portion of the female mold, which portion is adjacent to the drawing edge region and comes into contact with the workpiece when said workpiece is being formed and press hardened. The material applied in the drawing edge region, or the insert part arranged there, which according to the invention has a relatively low thermal conductivity is configured such that the surface thereof facing the workpiece has a transverse dimension which extends over the drawing edge and is within the range of 1.6 times to 10 times, preferably within the range of 1.6 times to 6 times the positive radius of the female mold. The transverse extent (transverse dimension) of the material or insert part having a relatively low thermal conductivity and arranged in the drawing edge region is thus limited and relatively small.

The coated sheet steel (workpiece) to be formed is subjected to high plastic deformations particularly in the drawing edge region, defined by a positive die radius, of the female mold. Due to the action of the punch, in this region the workpiece initially experiences a compressive stress which changes into a tensile stress during the continued closing movement of the forming tool. The high temperature difference between the workpiece and the forming tool adversely affects the local flow characteristics of the workpiece in a conventional forming tool, particularly in the die radius of a conventional forming tool, and cracks frequently appear in the coating, for example in the layer of zinc. With an increasing sheet thickness and subject to the complexity of the shape of the component to be produced, differing crack depths can appear which can extend right into the sheet of the coated component.

According to the invention, the material applied, for example by coating in the drawing edge region, having a relatively low thermal conductivity, or the insert part arranged there, having a relatively low thermal conductivity, is dimensioned to ensure that the component produced by hot forming and press hardening has a substantially completely martensitic structure. In this respect, the part of the press-hardened component, influenced by the drawing edge of the female mold, i.e. by the material or insert part having a relatively low thermal conductivity, can have a tower hardness than another part or than the remaining part of the component, although according to the invention, this part, influenced thus, of the press-hardened component always has a hardness which is above the required minimum hardness and corresponds to a martensitic structure. In this manner, cracks in the coating, for example in a zinc layer, and also in the correspondingly coated sheet are avoided or at least the crack depths in the coating or in the coated sheet are considerably reduced.

The stresses and strains which occur when the coated, for example galvanized, workpiece (sheet steel) is hot formed and also the solidification which occurs in the forming process are reduced by the reduced loss of heat or temperature compared to that in a conventional temperature-controlled forming process. Consequently, a possible local material failure is also reduced or prevented.

The present invention thus improves the flow characteristics of workpieces of sheet steel during hot forming and thereby significantly reduces the risk of cracks appearing during the hot forming of workpieces of sheet steel, preferably galvanized steel blanks.

In particular, the present invention improves the feasibility of components which have a complex three-dimensional shape and are to be produced from coated sheet steel, for example from galvanized sheet steel.

A preferred configuration of the solution according to the invention provides that the thermal conductivity of the insert part, arranged in the drawing edge region, or of the applied material, is less than 40 W/(m*K), preferably less than 30 W/(m*K) and particularly preferably less than 20 W/(m*K). This measure advantageously reduces the loss of heat or temperature during the hot forming of the workpiece and accordingly improves the forming behaviour of the workpiece.

A further advantageous configuration of the solution according to the invention is characterised in that a heat insulating layer is arranged between the insert part and the female mold. This measure can further reduce the loss of heat or temperature during the hot forming of the workpiece. In particular, this configuration allows the use of an insert part which is produced from a particularly wear-resistant material but which has a relatively high thermal conductivity, it being possible for the heat insulating layer which, compared to the insert part forming the drawing edge region, is not exposed to a high mechanical stress, and in particular is not exposed to a high frictional stress, to consist of a thermally insulating material, for example a plastics material or wood material, having low wear resistance.

A further advantageous configuration of the solution according to the invention provides that the insert part has a projection which protrudes with respect to the inner periphery of the female mold and/or with respect to the peripheral surface adjoining the cavity of the female mold. This projection, by forming a local elevation, can reduce even more effectively the dissipation of heat from the workpiece to be formed upstream of the die radius.

A further advantageous configuration of the solution according to the invention is characterised in that the material applied in the drawing edge region of the female mold is applied to the female mold by build-up welding, preferably by laser build-up welding. In this manner, the thermal conductivity in the drawing edge region of the female mold can be reduced in a reliable and relatively simple manner. The material application having a relatively low thermal conductivity can be renewed economically by build-up welding, preferably by laser build-up welding, when this is necessary due to abrasion (erosion) caused by wear.

A further advantageous configuration of the solution according to the invention is characterised in that the drawing edge region of the female mold is heated in a locally selective manner by a heat source, integrated into the female mold, or by a duct conducting a heating fluid. This configuration can also significantly reduce the dissipation of heat from the workpieee to be formed and can thereby improve the flow characteristics of the steel material during hot forming.

It also lies within the scope of the present invention to combine together a plurality of the aforementioned configurations or all the aforementioned configurations of the solution according to the invention.

BRIEF DESCRIPTION OF THE DRAWINGS

In the following, the invention will be described in more detail with reference to schematic drawings which illustrate a plurality of embodiments.

DETAILED DESCRIPTION OF THE INVENTION

Figure 1:
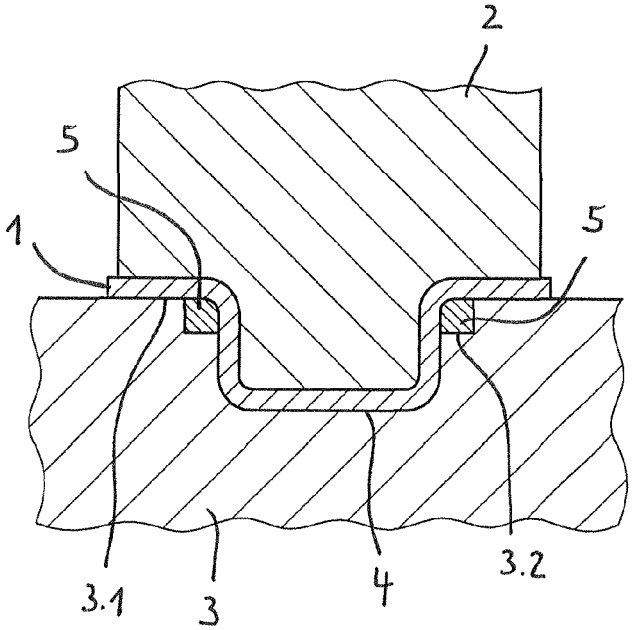
FIG. 1 is a sectional view of a portion of a forming tool according to the invention.
Figure 2:
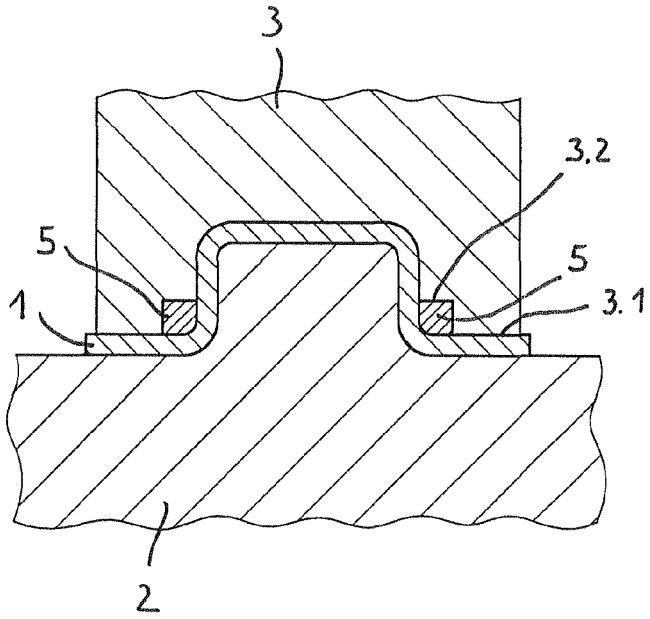
FIG. 2 is a sectional view of a portion of a further forming tool according to the invention.

FIGS. 1 and 2 respectively show portions of cooled forming tools for hot forming and press hardening a plate-shaped or preformed workpiece 1 of sheet steel, in particular a galvanized workpiece of sheet steel. Reference numeral 2 denotes a punch and reference numeral 3 denotes a female mold (forging die) of the respective forming tool. Furthermore, the forming tool shown in FIG. 1 and/or FIG. 2 can optionally have a blank holder which presses the workpiece 1 against the female mold 3 during the forming process. However, the forming tool according to the invention is preferably configured without a blank holder.

The female mold (forging die) 3 contains a cavity 4 into which the punch 2 penetrates while the workpiece 1 is being formed or deep drawn. FIGS. 1 and 2 both show the respective forming tool in a closed state with the workpiece 1 formed therein.

Cooling ducts (not shown) for conducting a cooling fluid are provided in the punch 2 and/or in the female mold 3 near the shaping surface of the tool. Before the workpiece 1 which is to be formed is introduced into the open forming tool, it is initially heated to a target temperature, preferably to a temperature above the austenitisation temperature, and is then formed and quenched in the cooled forming tool.

Before the forming procedure, the temperature of the heated plate-shaped or preformed workpiece 1 is preferably kept as high as possible to improve the flow characteristics, effective during forming, of the workpiece 1 or to reduce the stresses and/or strains. This can be influenced, for example, by the selected level of heating temperature and/or by short transfer times, i.e. short handling times between the heating device (not shown), for example a continuous furnace, and the start of the forming process.

The forming tool according to the invention is characterised by an optimised heat transfer coefficient. This prevents an excessively fast local cooling of the heated workpiece 1 (for example of the galvanized steel blank) after its being positioned and during its forming in the tool. According to the invention, at least the female mold 3 is optimised in respect of its heat transfer coefficient. For this purpose, the female mold 3 is coated with material in a material-uniting manner in its drawing edge region defined by a positive die radius and/or is provided there with at least one insert part 5 which has a thermal conductivity lower by at least 10 W/(m*K) than the thermal conductivity of the portion 3.1, adjacent to the drawing edge region, of the female mold 3, which portion 3.1 comes into contact with the workpiece during the hot forming and press hardening of said workpiece. In this respect, the means with a relatively low thermal conductivity are dimensioned in order to ensure that a fully martensitic structure is still produced in the formed component (workpiece) 1 after the end of the quenching procedure (press hardening), whereas the workpiece region influenced by the drawing edge region and configured according to the invention can have a reduction in hardness which, however, must be within the range of the required minimum hardness, as a result of which cracks in the workpiece 1 can be avoided or crack depths can be reduced. Therefore, according to the invention, the surface facing the workpiece 1, of the material 6 applied in the drawing edge region (cf. FIG. 3), or of the insert part 5 arranged there, has a transverse dimension which extends over the drawing edge 7 and is within the range of 1.6 times to 10 times the positive die radius of the female mold 3.

In the embodiments illustrated in FIGS. 1 and 2, the respective female mold 3 has in its drawing edge region, defined by a positive die radius, at least one insert part 5, the thermal conductivity of which is preferably less than 40 W/(m*K), particularly preferably less than 30 W/(m*K). The at least one insert part 5 is configured in the form of a ring or a strip and is inserted into a recess 3.2 formed in the drawing edge region of the female mold 3.

FIG. 3 to 8 schematically illustrate further embodiments of a forming tool according to the invention, preferably of a female mold 3.

Figure 3:
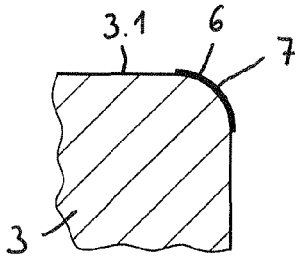
FIG. 3 is a sectional view of a portion, comprising a drawing edge, of a forming tool according to the invention, having a coating which is arranged in the drawing edge region and has a relatively low thermal conductivity.

In the embodiment illustrated in FIG. 3, a female mold 3 used for hot forming and press hardening is coated in its drawing edge region, defined by a positive die radius, with a material 6 which has a relatively low thermal conductivity. The material (coating) 6 is preferably ceramics, for example aluminium oxide or zirconium oxide. The drawing edge region can be selectively coated by, for example, flame spraying, in particular by powder flame spraying or by wire flame spraying, or by arc spraying or plasma spraying.

The transverse dimension of the coating 6 extending over the drawing edge 7 is, for example within the range of 1.6 times to 4 times, preferably within the range of 1.6 times to twice the positive die radius of the female mold 3. The coating 6 stands, or can protrude slightly with respect to the adjacent surface 3.1 of the female mold 3, for example by approximately 0.25 mm to 0.5 mm or even more.

Figure 4:
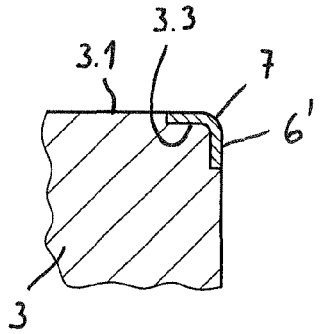
FIGS. 4 and 7 are in each case sectional views of a portion, comprising a drawing edge, of a forming tool according to the invention, with material which is applied by build-up welding in the drawing edge region and which respectively has a relatively low thermal conductivity.

In the embodiment illustrated in FIG. 4, the female mold 3 used for hot forming and press hardening is provided in the drawing edge region with a material application 6' which is produced by build-up welding and has a relatively low thermal conductivity. Before the build-up welding process, a depression 3.3 which extends transversely over the drawing edge is produced, for example by machining in the drawing edge region of the female mold 3. The material 6' having a relatively low thermal conductivity is then arranged in this depression (recess) 3.3 by build-up welding. This applied material 6' can be, for example, chromium steel, titanium or high-alloy steel, such as X5CrNi18-10, all of which have a thermal conductivity of approximately 30 W/(m*K) or less than 30 W/(m*K). The material 6' applied to the drawing edge region by build-up welding is applied and is then diminished in size by milling or grinding until it substantially terminates flush in the surface 3.1 of the female mold 3 or slightly protrudes with respect to the surface 3.1. of the female mold 3.

Figure 5:
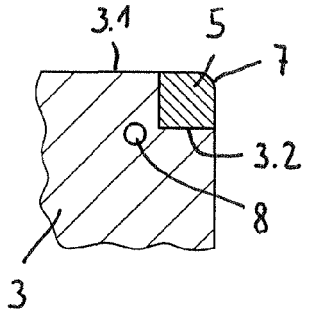
FIGS. 5, 6 and 8 are in each case sectional views of a portion, comprising a drawing edge, of a forming tool according to the invention, with an insert part which is arranged in the drawing edge region and has a relatively low thermal conductivity.

The portion of the female mold 3 illustrated in FIG. 5 substantially corresponds to the embodiment illustrated in FIG. 1. Here as well, a strip-shaped insert pan 5 of a relatively low thermal conductivity is arranged in the drawing edge region of the female mold 3. The insert part 5 consists, for example, of ceramics, preferably of aluminium oxide ($Al_2O_3$) or of zirconium oxide. The outer side of the insert part 5 forming the drawing edge region terminates substantially flush with the surface 3.1. of the female mold 3.

FIG. 5 also shows a further option or alternative for reducing the heat loss of the heated workpiece. This alternative or additional option comprises integrating into the female mold 3 a heat source or a duct 8 conducting a heating fluid, by which the drawing edge region of the female mold 3 can be heated in a locally selective manner. A further preferred embodiment provides that the treat source, for example in the form of one or more electric heating wires, or the duct 8 conducting a heating fluid, is integrated into the insert part 5 which forms the drawing edge region.

Figure 6:
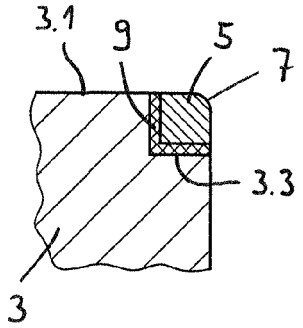

The embodiment illustrated in FIG. 6 differs from the embodiments illustrated in FIGS. 1, 2 and 5 in that a heat insulating layer 9 is arranged between the insert part 5 and the female mold 3. The heat insulating layer 9 is configured with one or more layers and consists, for example, of plastics material and/or of mineral wool.

Figure 7:
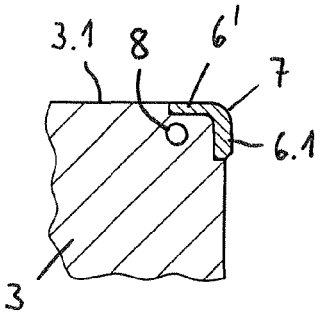

In the embodiment illustrated in FIG. 7, a female mold 3 used for hot forming and press hardening is again provided in the drawing edge region with a material application 6' which is produced by build-up welding and has a relatively low thermal conductivity. However, in contrast to the embodiment according to FIG. 4, the material application 6' is configured such that it has a projection 6.1 which protrudes with respect to the inner periphery of the female mold 3 or with respect to the peripheral surface adjoining the cavity 4 of the female mold 3. The dissipation of heat from the heated workpiece 1 is reduced by this local elevation or by this local projection 6.1 consisting of a material having a relatively low thermal conductivity. In addition to this material application 6', here again it is possible to integrate into the female mold 3 a heat source or a duct 8 conducting a heating fluid, by which the drawing edge region of the female mold 3 can be heated in a locally selective manner.

Figure 8:
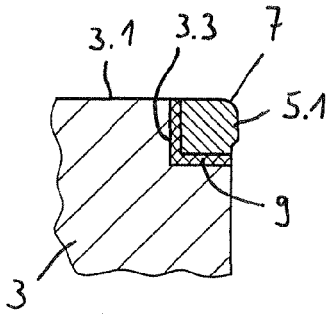

The embodiment illustrated in FIG. 8 differs from the embodiment illustrated in FIG. 6 in that the insert part 5 has a projection 5.1 which protrudes with respect to the inner periphery of the cavity 4 of the female mold 3 or with respect to the peripheral surface adjoining the cavity 4. In this regard, reference numeral 9 again denotes a heat insulating layer arranged between the insert part 5 and the female mold 3.

The implementation of the present invention is not restricted to the embodiments which have been described above and/or have been illustrated in the drawings. In fact, numerous variants or modifications are conceivable, which also make use of the invention specified in the accompanying claims in a form which differs from the embodiments. Thus, for example, additionally the punch and/or optionally also the blank holder can be provided with means 5, 5.1, 6, 6', 6.1 and/or 9 having a low thermal conductivity to optimise the heat transfer coefficient.

The invention claimed is:

1. A method for hot forming and press hardening plate-shaped or preformed workpieces of galvanized sheet steel, comprising heating the workpiece to a temperature above the austentisation temperature, forming the workpiece in a cooled forming tool, the forming tool having a punch and a female mold, the female mold comprising a cavity into which the punch penetrates to form the workpiece into the cavity, wherein the cavity of the female mold is adjoined by a drawing edge at a corner part of the female mold defined by a positive die radius that contacts the workpiece at a peripheral portion thereof, and quenching the workpiece in said forming tool, wherein the drawing edge region of the female mold is provided with at least one insert part which forms the positive die radius of the female mold, said insert part having a thermal conductivity being at least 10 W/(m*K) lower than the thermal conductivity of an adjacent portion of the female mold adjacent to the drawing edge region that comes into contact with a remaining portion of the workpiece during the forming and quenching of said workpiece, wherein the insert part has a transverse dimension which extends over the drawing edge region, being within the range of 1.6 times to 10 times the positive radius of the female mold, wherein after quenching, substantially all of the workpiece has a martensitic structure with the peripheral portion of the workpiece that contacts the insert part has a hardness lower than that of the remaining portion of the workpiece but still has a martensitic structure due to the lower thermal conductivity of the insert part.

2. The method according to claim 1, wherein the thermal conductivity of the insert part arranged in the drawing edge region is less than 40 W/(m*K).

3. The method according to claim 1, including configuring the insert part in the form of a strip and inserting the insert part into a recess formed in a corner region of the female mold.

4. The method according to claim 1, including arranging a heat insulating layer between the insert part and the female mold.

5. The method according to claim 1, wherein the insert part has a projection which protrudes with respect to an inner periphery of the female mold and/or with respect to a peripheral surface adjoining a cavity of the female mold.

6. The method according to claim 1, including heating the drawing edge region of the female mold in a locally selective manner by a heat source integrated into the female mold or by a duct conducting a heating fluid.

7. A method for hot forming and press hardening plate-shaped or preformed workpieees of galvanized sheet steel, comprising:

heating the workpiece to a temperature above the austentisation temperature, forming the workpiece in a cooled forming tool, the forming tool having a punch and a female mold, the female mold comprising a cavity into which the punch penetrates to form the workpiece into the cavity, wherein the cavity of the female mold is adjoined by a drawing edge region at a corner part of the female mold defined by positive die radius that contacts the workpiece at a peripheral portion thereof, and quenching the workpiece in said forming tool;

wherein the female mold is coated in the drawing edge region, defined by the positive die radius, with material, in a material-uniting manner, said material forming an exterior portion of the positive die radius, said material having a thermal conductivity being at least 10 W/(m*K) lower than the thermal conductivity of an adjacent portion of the female mold adjacent to the drawing edge region that comes into contact with a remaining portion of the workpiece during the forming and quenching of said workpiece, wherein a surface of the material applied in the drawing edge region facing the workpiece has a transverse dimension which extends over the drawing edge region, being within the range of 1.6 times to 10 times the positive radius of the female mold, wherein after quenching, substantially all of the workpiece has a martensitic structure with the peripheral portion of the workpiece that contacts the coating material on the female mold has a hardness lower than that of the remaining portion of the workpiece but still has a martensitic structure due to the lower thermal conductivity of the coating material.

8. The method according to claim 7, including applying the material in the drawing edge region of the female mold to the female mold by build-up welding.

9. The method according to claim 7, including heating the drawing edge region of the female mold in a locally selective manner by a heat source integrated into the female mold or by a duct conducting a heating fluid.

* * * * *